US006469688B1

(12) United States Patent
Livingston et al.

(10) Patent No.: US 6,469,688 B1
(45) Date of Patent: Oct. 22, 2002

(54) EXTENSIBLE, INTERACTIVE BITMAPS IN A GRAPHICAL USER INTERFACE

(75) Inventors: Kris R. Livingston, Boise, ID (US); Ward S. Foster, Boise, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/365,656

(22) Filed: Aug. 2, 1999

(51) Int. Cl.[7] ..... G09G 5/00
(52) U.S. Cl. ..... 345/123; 345/660
(58) Field of Search ..... 345/356, 357, 345/352, 353, 121, 127, 129, 132, 350, 145, 590, 634, 635, 641, 638; 341/50; 340/734

(56) References Cited

U.S. PATENT DOCUMENTS 5,227,771 A * 7/1993 Kerr et al. ..... 340/731
5,555,002 A * 9/1996 Nguyen ..... 345/121
5,682,152 A * 10/1997 Wang et al. ..... 341/150
5,689,284 A * 11/1997 Herget ..... 345/145
5,689,669 A * 11/1997 Lynch et al. ..... 395/355
5,838,319 A * 11/1998 Guzak et al. ..... 345/340
5,896,133 A * 4/1999 Lynch et al. ..... 345/357
5,917,492 A * 6/1999 Bereiter et al. ..... 345/357
6,115,043 A * 9/2000 Levine et al. ..... 345/350
6,151,421 A * 11/2000 Yamada ..... 345/634

OTHER PUBLICATIONS

Canon (Zerox machine Manual), 1997.*

* cited by examiner

*Primary Examiner*—Vijay Shankar
*Assistant Examiner*—Nitin Patel

(57) ABSTRACT

A base bitmap image is displayed with an extension bitmap element in a display area. Positioning information is discovered for positioning the base bitmap image relative to the display area. The base bitmap image is loaded. A list is examined to determine the presence and location of the extension bitmap element. Positioning information is discovered for positioning the extension bitmap element relative to the display area. The extension bitmap element is loaded. The base bitmap image and the extension bitmap element are then displayed according to the positioning information for each.

18 Claims, 2 Drawing Sheets

EXTENSIBLE, INTERACTIVE BITMAPS IN A GRAPHICAL USER INTERFACE

FIELD OF THE INVENTION

This invention relates in general to interactive bitmap images and, more particularly, to adding extension bitmap elements to interactive bitmap images.

BACKGROUND OF THE INVENTION

Interactive software allows a user to interact with the real world device through the interactive bitmap images. Interactive bitmap images are used for a variety of applications to provide an intuitive, interactive display for a user. Interactive bitmap images are often used to represent a real world device or apparatus such as a peripheral device for a computer. Portions of the real world devices are represented by interactive portions of the interactive bitmap images. Software allows a user to interact with the real world device through the interactive bitmap images. For example, a paper tray may be selected for a printer by selecting the interactive portion representing the paper tray in the interactive bitmap image.

The real world devices represented by interactive bitmap images are often able to support add-on accessories. The accessories enhance the functionality of the real world device. For example, a real world device such as a printer may support add-on paper handling devices. The paper handling devices are accessories that enhance the functionality of the printer.

Often, when an interactive bitmap image is used with a real world device, it is desirable that the add-on accessories be represented in the interactive bitmap image. One solution for representing the accessories in the interactive bitmap image is to include in the interactive software all of the bitmaps and the interactive information for all presently known accessories for a device. Interactive information is the information necessary for the software to make the bitmap image interactive.

Including all of the bitmaps and interactive information for all presently known accessories requires a significant investment of time and expense. Additionally, as new accessories are developed for the device, updates must be made to the software.

SUMMARY OF THE INVENTION

According to principles of the present invention, a base bitmap image is displayed with an extension bitmap element in a display area. Positioning information is discovered for positioning the base bitmap image relative to the display area. The base bitmap image is loaded. A list is examined to determine the presence and location of the extension bitmap element. Positioning information is discovered for positioning the extension bitmap element relative to the display area. The extension bitmap element is loaded. The base bitmap image and the extension bitmap element are then displayed according to the positioning information for each. If desired, multiple extension bitmap elements may be displayed with the base bitmap image.

According to further principles of the present invention, the extension bitmap element is interactive. The size and location are discovered for each interactive portion of the extension bitmap element. Additionally, at least one interactive response is discovered for each interactive portion of the extension bitmap element.

Other objects, advantages, and capabilities of the present invention will become more apparent as the description proceeds.

DETAILED DESCRIPTION OF THE INVENTION

Figure 1:
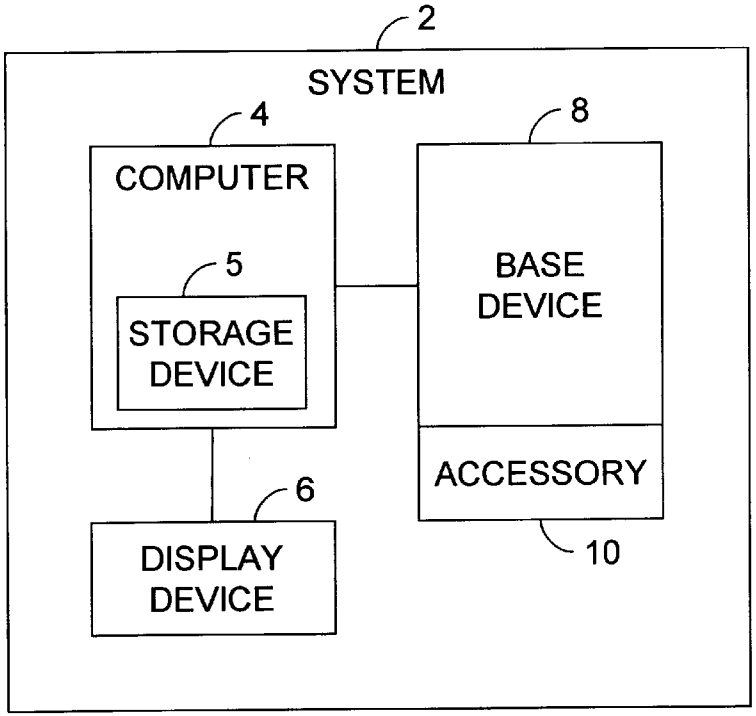
FIG. 1 is a block diagram illustrating a system for practicing the present invention.

FIG. 1 shows a system 2 having a computer or processor 4, a display device 6, a base apparatus 8, and an accessory 10. System 2 is either a single device, such as a copier or facsimile machine, or a collection of individual components, such as a computer system with a printer.

Computer 4 is any general or specific purpose computing device. For example, if system 2 is a collection of individual components, computer 4 is a general purpose computer and if system 2 is a single device, computer 4 is a processor for controlling system 2. Computer 4 may include one or more storage devices 5 for storing information in electronic form. Examples of storage devices 5 include storage disks and random access memory.

Display device 6 is any device capable of displaying a bitmap image. Display device 6 includes at least one surface for displaying the bitmap images. Examples of display device include a computer monitor and a display screen for a stand alone device.

Base apparatus 8 is any functioning device, such as a printer, capable of supporting an accessory 10. Accessory 10 is any add-on accessory, such as an add-on paper tray, for base apparatus 8.

Figure 2:
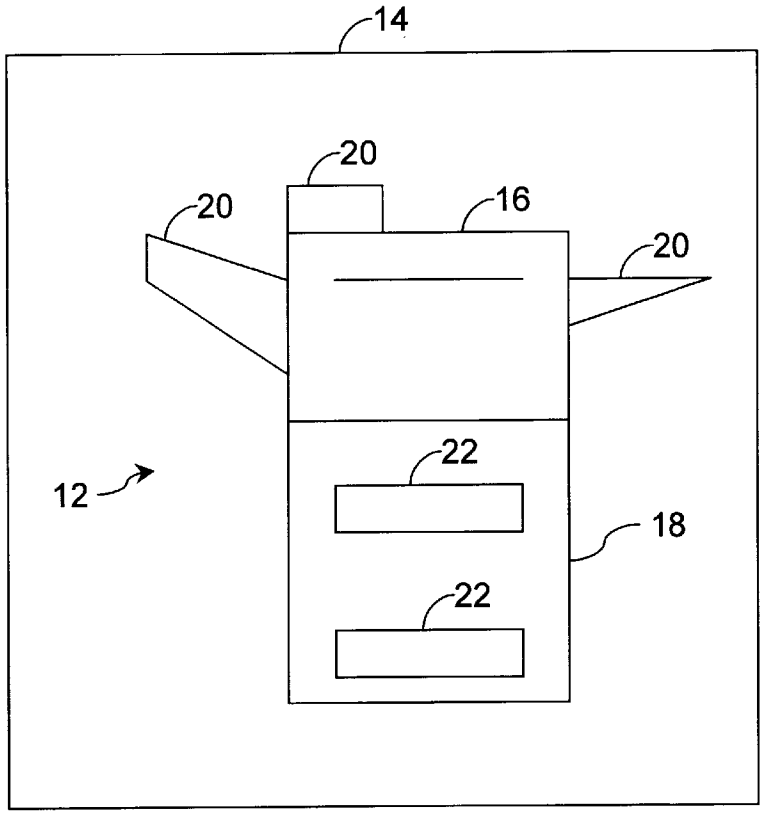
FIG. 2 is a sample bitmap image displayed in a display area.

FIG. 2 illustrates an example of a bitmap image 12 displayed in a display area 14. Display area 14 is an area within display device 6 for displaying images. Display area 14 may include all of the display surface of display device 6 or only a portion of the display surface of display device 6.

Bitmap image 12 includes a base bitmap image 16 and an extension bitmap element 18. Although, only one extension bitmap element 18 is shown, multiple extension bitmap elements 18 may be included and are within the scope of the present invention.

Base bitmap image 16 represents base apparatus 8 and extension bitmap element 18 represents accessory 10. Interactive portions 20 of base bitmap image 16 represent user selectable or configurable portions of base apparatus 8. Similarly, interactive portions 22 of extension bitmap element 18 represent user selectable or configurable portions of accessory 10.

In one embodiment, base bitmap image 16 and extension bitmap element are stored on storage device 5 or some other storage device or data source. Additionally, a list is stored on storage device 5 or some other storage device or data source. The list identifies each extension bitmap element 18 to be displayed with base bitmap image 16. The list also includes the location where each extension bitmap element 18 may be found, the size of each extension bitmap element 18, and at least one offset value for each extension bitmap element 18 relative to an origin of the display area. The information in the list allows computer 4 to retrieve and display each extension bitmap element 18 in display area 14.

Also stored on storage device 5, or some other storage device or data source, is interactive information for each extension bitmap element 18. The interactive information includes dimensions for each interactive portion 22 of extension bitmap element 18, a location for each interactive portion 22 of extension bitmap element 18, and at least one interactive response for each interactive portion 22 of extension bitmap element 18. The interactive response tells computer 4 what to do when the interactive portion 22 is selected. For example, in a printer accessory such as a paper handling device, selecting an interactive portion of an interactive bitmap tells the computer from which paper tray of the paper handling device to draw paper.

Figure 3:
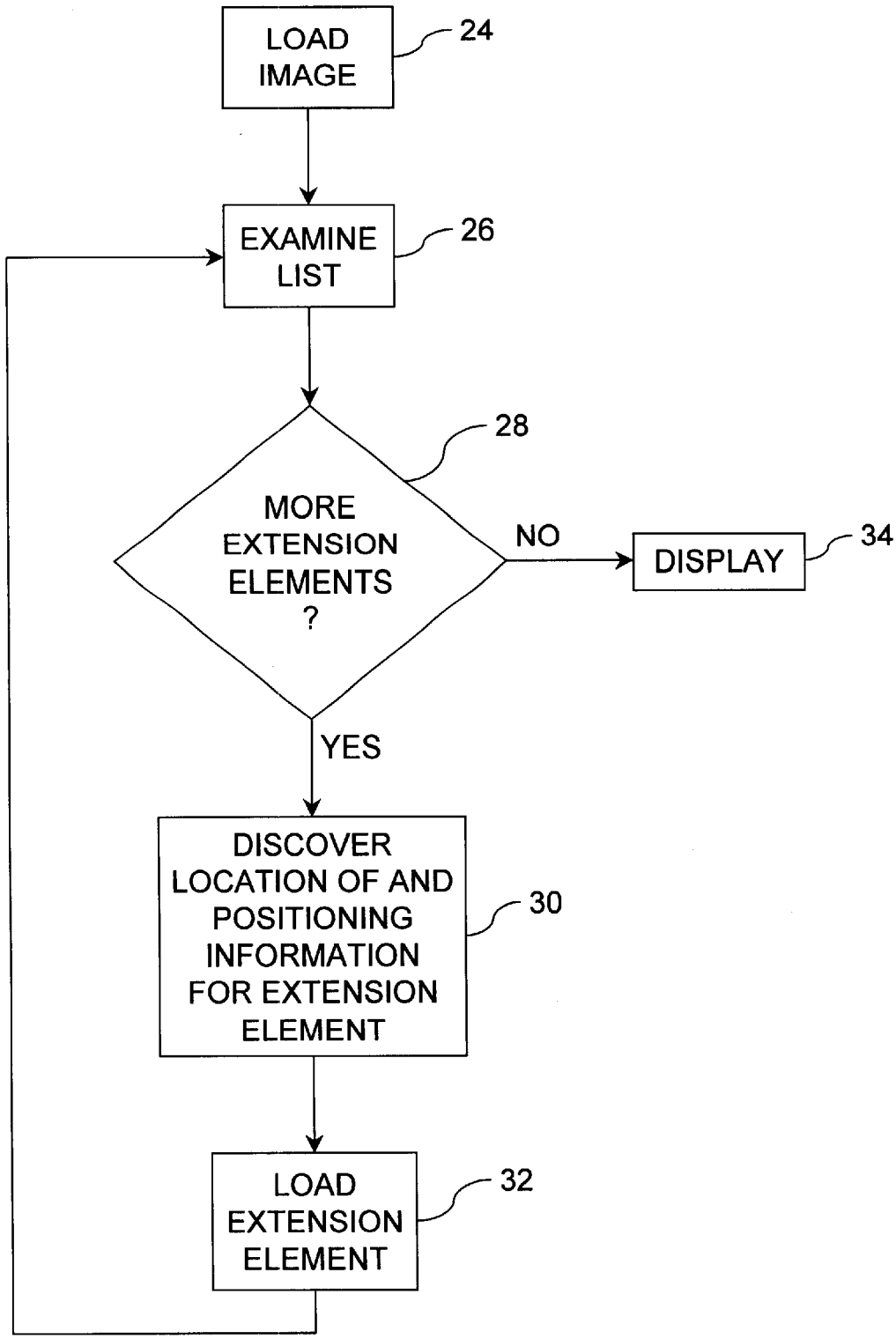
FIG. 3 is a flow chart illustrating one embodiment of the method of the present invention.

FIG. 3 is block diagram illustrating one embodiment of the method of the present invention. Although the steps of the method are present in a specific order in FIG. 3, the steps may be executed in other orders, or simultaneously without departing from the scope of the present invention.

Base bitmap image 16 is loaded 24. In one embodiment, base bitmap image 16 is loaded 24 by computer 4 from a storage device 5, such as a hard drive, into another storage device 5, such as random access memory. In an alternate embodiment, base bitmap image 16 is loaded 24 from another storage device or data source. The source of base bitmap image 16 is not significant.

Extension bitmap element 18 is discovered. Extension bitmap element 18 may be discovered by any means. In one embodiment, a list is examined 26 to discover the extension bitmap elements 18 for display. The list may be embodied in a data file or a configuration file for the software running on computer 4 that displays bitmap image 12.

If 28 there is an extension bitmap element 18 to be displayed, the location of and positioning information for extension bitmap element 18 is discovered 30. The location of and positioning information for extension bitmap element 18 is discovered 30 by any means. In one embodiment, the location and positioning information is discovered 30 by reading it from a list.

Extension bitmap element 18 is loaded 32. In one embodiment, Extension bitmap element 18 is loaded 32 by computer 4 from a storage device 5, such as a hard drive, into another storage device 5, such as random access memory. In an alternate embodiment, extension bitmap element 18 is loaded 32 from another storage device or data source. The source of extension bitmap element 18 is not significant.

After loading 32 extension bitmap element 18, other extension bitmap elements 18 are discovered if there are any. If there are no other extension bitmap elements 18, bitmap image 12 is displayed 34. Bitmap image 12 is displayed 34 by displaying base bitmap image 16 and extension bitmap element 18 within display area 14 according to the positioning information for bitmap image 16 and extension bitmap element 18.

It should be understood that the foregoing description is only illustrative of the invention. Various alternatives and modifications can be devised by those skilled in the art without departing from the invention. Accordingly, the present invention is intended to embrace all such alternatives, modifications and variances that fall within the scope of the appended claims.

What is claimed is:

1. A method for displaying a base bitmap image and an extension bitmap element in a display area, the method comprising:

(a) discovering positioning information for the base bitmap image relative to and within the display area;

(b) loading the base bitmap image;

(c) discovering the extension bitmap element;

(d) discovering positioning information for the extension bitmap element relative to and within the display area;

(e) discovering interactive information for the extension bitmap element;

(f) loading the extension bitmap element; and, (g) displaying the base bitmap image together with the extension bitmap element according to the positioning information for the base bitmap image and the extension bitmap element.

2. The method of claim 1 wherein discovering the extension bitmap element includes reading an identifier for the extension bitmap element from a list.

3. The method of claim 1 wherein discovering the extension bitmap element includes reading a location of the extension bitmap element from a list.

4. The method of claim 1 wherein discovering the extension bitmap element includes reading a size of the extension bitmap element from a list.

5. The method of claim 1 wherein discovering the positioning information for the extension bitmap element includes reading from a list, at least one offset value for the extension bitmap element relative to an origin of the display area.

6. The method of claim 1 wherein discovering interactive information for the extension bitmap element includes:

(a) dimensions for each interactive portion of the extension bitmap element;

(b) a location for each interactive portion of the extension bitmap element; and, (c) at least one interactive response for each interactive portion of the extension bitmap element.

7. A system for displaying a base bitmap image and an extension bitmap element in a display area, the system comprising:

(a) positioning information relative to and within the display area for the base bitmap image and the extension bitmap element;

(b) means for loading the base bitmap image;

(c) means for discovering the extension bitmap element;

(d) interactive information for the extension bitmap element;

(e) means for loading the extension bitmap element; and, (f) means for displaying the base bitmap image together with the extension bitmap element according to the positioning information for the base bitmap image and the extension bitmap element.

8. The system of claim 7 wherein the means for discovering the extension bitmap element includes:

(a) a list having an identifier for the extension bitmap element; and, (b) means for reading the identifier for the extension bitmap element from the list.

9. The system of claim 7 wherein the means for discovering the extension bitmap element includes:

(a) a list having a location of the extension bitmap element; and, (b) means for reading the location of the extension bitmap element from the list.

10. The system of claim 7 wherein the means for discovering the extension bitmap element includes:

(a) a list having a size of the extension bitmap element; and, (b) means for reading the size of the extension bitmap element from the list.

11. The system of claim 7 wherein the positioning information for the extension bitmap element includes at least one offset value for the extension bitmap element relative to an origin of the display area.

12. The system of claim 7 wherein the interactive information for the extension bitmap element includes:

(a) dimensions for each interactive portion of the extension bitmap element;

(b) a location for each interactive portion of the extension bitmap element; and, (c) at least one interactive response for each interactive portion of the extension bitmap element.

13. A program storage system readable by a computer, tangibly embodying a program, applet, or instructions executable by the computer to perform method steps displaying a base bitmap image and an extension bitmap element in a display area, the method steps comprising:

(a) discovering positioning information for the base bitmap image relative to and within the display area;

(b) loading the base bitmap image;

(c) discovering the extension bitmap element;

(d) discovering positioning information for the extension bitmap element relative to and within the display area;

(e) discovering interactive information for the extension bitmap element (f) loading the extension bitmap element; and, (g) displaying the base bitmap image together with the extension bitmap element according to the positioning information for the base bitmap image and the extension bitmap element.

14. The program storage system of claim 13 wherein the method step of discovering the extension bitmap element includes reading an identifier for the extension bitmap element from a list.

15. The program storage system of claim 13 wherein the method step of discovering the extension bitmap element includes reading a location of the extension bitmap element from a list.

16. The program storage system of claim 13 wherein the method step of discovering the extension bitmap element includes reading a size of the extension bitmap element from a list.

17. The program storage system of claim 13 wherein the method step of discovering the positioning information for the extension bitmap element includes reading from a list, at least one offset value for the extension bitmap element relative to an origin of the display area.

18. The program storage system of claim 13 wherein the method step of discovering interactive information for the extension bitmap element includes:

(a) dimensions for each interactive portion of the extension bitmap element;

(b) a location for each interactive portion of the extension bitmap element; and, (c) at least one interactive response for each interactive portion of the extension bitmap element.

* * * * *

UNITED STATES PATENT AND TRADEMARK OFFICE

CERTIFICATE OF CORRECTION

PATENT NO. : 6,469,688 B1
DATED : October 22, 2002
INVENTOR(S) : Livingston et al.

It is certified that error appears in the above-identified patent and that said Letters Patent is hereby corrected as shown below:

Column 2,
Line 57, after "element" insert -- 18 --.

Signed and Sealed this

Third Day of February, 2004

JON W. DUDAS
*Acting Director of the United States Patent and Trademark Office*